US005711179A

United States Patent [19]

Kimball

[11] Patent Number: 5,711,179

[45] Date of Patent: Jan. 27, 1998

[54] APPARATUS FOR DRIVING INDEXING CONVEYOR

[76] Inventor: Robert L. Kimball, 1559 Capac Dr., Allenton, Mich. 48002

[21] Appl. No.: 585,882

[22] Filed: Jan. 16, 1996

[51] Int. Cl.[6] ..... B21D 43/02

[52] U.S. Cl. ..... 72/361; 72/426

[58] Field of Search ..... 72/361, 426; 83/155; 198/814, 832.1; 226/157; 248/206.5

[56] References Cited

U.S. PATENT DOCUMENTS

| | | | |
|---|---|---|---|
| 1,714,143 | 5/1929 | Schramm | 226/157 |
| 2,677,456 | 5/1954 | McCann | 198/814 |
| 3,762,617 | 10/1973 | Matthis | 226/157 |
| 4,194,341 | 3/1980 | Kihnke et al. . | |
| 4,292,892 | 10/1981 | Combs . | |
| 4,303,054 | 12/1981 | Lore | 248/206.5 |
| 4,569,435 | 2/1986 | McGouney . | |
| 4,872,548 | 10/1989 | Masuda et al. . | |
| 4,961,337 | 10/1990 | Henning et al. | 72/361 |

OTHER PUBLICATIONS

Formsprag, Overrunning Clutches, Warner Electric, pp. 2–9.

*Primary Examiner*—Lowell A. Larson
*Attorney, Agent, or Firm*—Young & Basile, P.C.

[57] ABSTRACT

An indexing conveyor apparatus is driven with respect to a press having a reciprocal ram and bolster plate. An elongated conveyor is connectible to the press for moving material with respect to the press. The conveyor includes an endless conveyor belt disposed about a drive pulley at one end and an idler roller at an opposite end. A flexible member is connectible between the conveyor and the reciprocal ram for converting reciprocating movement of the ram into indexing movement of the endless conveyor belt through the drive pulley. The flexible member preferably includes a webbing material wound about a spool. The spool is spring biased to rewind the webbing on the spool while the ram is driven toward the bolster plate. As the ram is moved away from the bolster plate, the spool acting through a clutch drives the drive pulley to index the endless conveyor belt.

15 Claims, 2 Drawing Sheets

APPARATUS FOR DRIVING INDEXING CONVEYOR

FIELD OF THE INVENTION

The invention relates to an apparatus for driving an indexing conveyor, and more specifically to an indexing conveyor apparatus for conveying material from press machines.

BACKGROUND OF THE INVENTION

Typically, a motor is used to drive a belt conveyor, where the belt is positioned over rollers. The motor mounted on the conveyor as the drive source may increase the weight and size of the conveyor beyond the desired specifications. In addition, when it is desired to synchronize the motor with a press machine to provide intermittent feeding of the conveyor by a given length, a complicated control circuit is typically required to control the motor and correspondingly increases the manufacturing cost of the indexing conveyor.

Continuously operating conveyors have been used in the past to remove parts from the immediate area of a press. Press machines are commonly used to perform a wide variety of cutting, piercing and other forming operations on material in order to form the material into the desired shape. A press machine typically includes a bolster plate and a reciprocal ram. Corresponding dies are mounted to the bolster plate and the ram, such that movement of the ram, typically in a downward direction, will bring the dies into mating engagement and form the materials disposed therebetween to the desired shape.

It is desirable in the present invention to provide an intermittently operating conveyor to move material, such as workpieces, from a press machine. Furthermore, it is desirable in the present invention to provide a means for conveying the material from a press machine without requiring an electric motor, or an electric control circuit. In addition, it is desirable in the present invention to provide an indexing conveyor means releasibly connectible to the press machine. It is further desirable in the present invention to provide an indexing conveyor powered by movement of the ram between the extended and the retracted positions.

SUMMARY OF THE INVENTION

The present invention is capable of operating at a speed of 130 strokes per minute, while automatically accommodating presses of different length strokes, or shut heights. The conveyor according to the present invention is easily attached to any press with just two magnets, one for holding the conveyor unit in place on a bolster plate, while the other magnet is for attaching the conveyor drive webbing to the ram assembly. This allows the conveyor to be used in any application, or location, without any drilling or bolting being necessary. The present invention can be attached using magnets, since the conveyor according to the present invention only uses twelve to fourteen foot pounds (ft-lbs) to operate. The use of magnets for attachment also provides for quick installation which allows the conveyor to be moved in and out of presses as needed, even as often as on a daily basis. The conveyor of the present invention can advance 4½ inches per 6 inches of stroke of the press, or 9 inches of advancement on 12 inches of stroke. For every retracting stroke for the press ram from the bolster plate, the conveyor is advanced forward 3 inches for every 4 inches of ram retraction. When the ram is in the extended stroke, a clutch return spring is activated and automatically rewinds the clutch to an original ready position, for subsequent operation during the next press cycle. The conveyor according to the present invention includes simple construction and greatly reduces, or eliminates, the need for additional safety guards, since pinch points commonly existing in previously known conveyors have been eliminated. The conveyor according to the present invention preferably includes a pre-measured, endless fiberglass manufactured belt made to a length to match the desired conveyor. This construction eliminates many of the problems and failures associated with previously known conveyors constructed to use a laced belt, which can be subject to belt failure. Previously known conveyors typically included bolts and/or adjustment screws to be tightened and loosened in order to adjust the tightness of the belt. These tighteners can easily be misaligned causing the belt not to track properly resulting in premature belt failure. The conveyor according to the present invention is equipped with means for biasing a nosepiece to keep the belt tension even, thereby allowing the belt to track evenly. The conveyor according to the present invention is open on both ends allowing an endless belt to be quickly installed without requiring the use of tools, and also allows the endless belt to be quickly removed for cleaning of greases, or other contaminants, generated during stamping operations. Due to the construction of the conveyor according to the present invention, the conveyor is very light, and typically weighs only one-half of the weight of other motor driven conveyors of corresponding size. The small parts indexing conveyor according to the present invention provides a unique means for powering the indexing movement of the conveyor in an energy efficient manner and with reduced requirements for maintenance.

An apparatus according to the present invention drives an indexing conveyor with respect to a press having a reciprocal ram moving with respect to a bolster plate. The apparatus includes elongated conveyor means connectible to the press for moving material with respect to the press. The conveyor means includes an endless conveyor belt disposed about a drive pulley at one end and an idler roller at an opposite end. The apparatus also includes flexible means connectible between the conveyor means and the reciprocal ram for converting reciprocating movement of the ram into indexing movement of the endless conveyor belt through the drive pulley.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
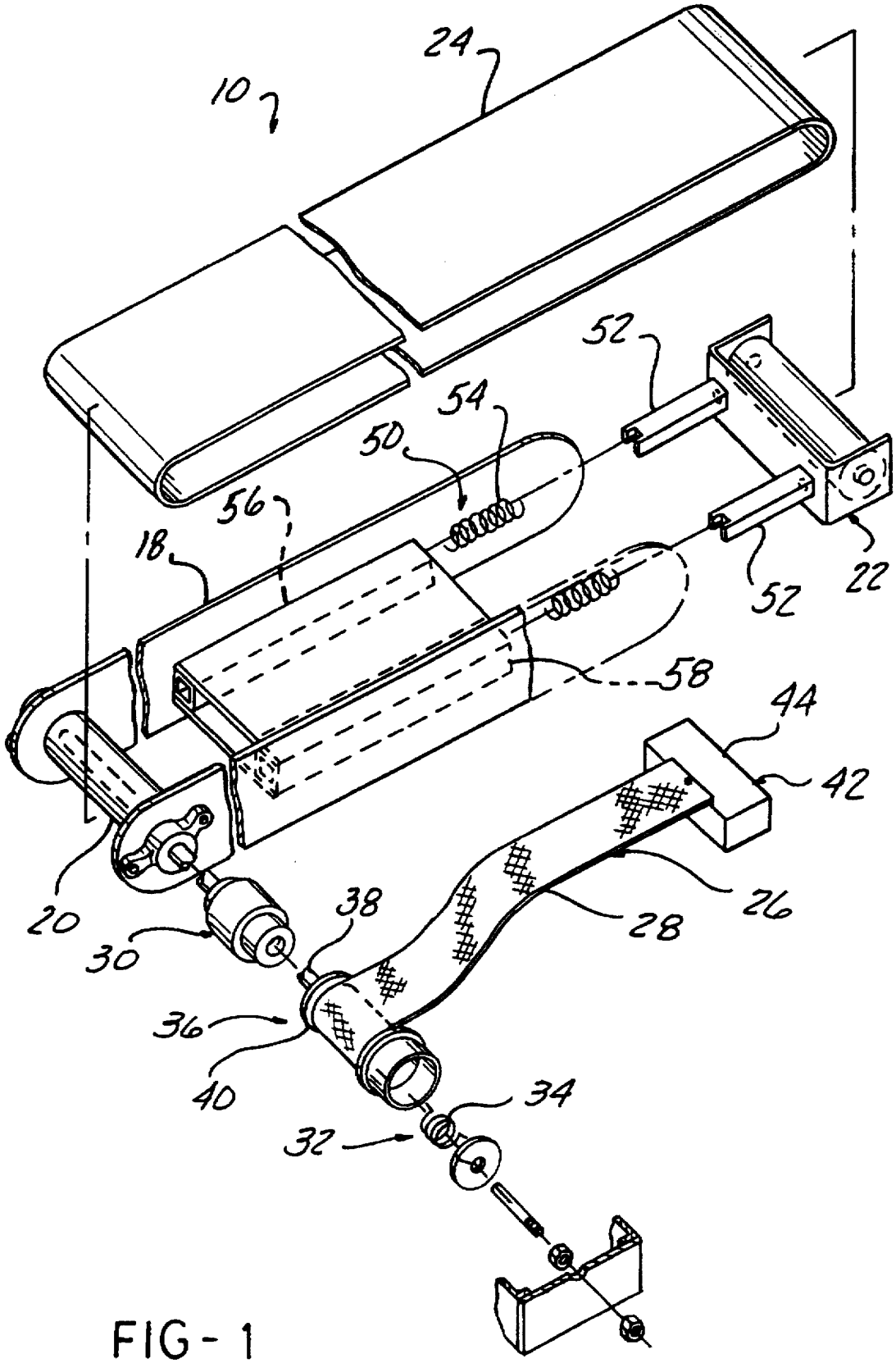
FIG. 1 is a perspective, exploded view of an apparatus for driving an indexing conveyor according to the present invention.
Figure 2:
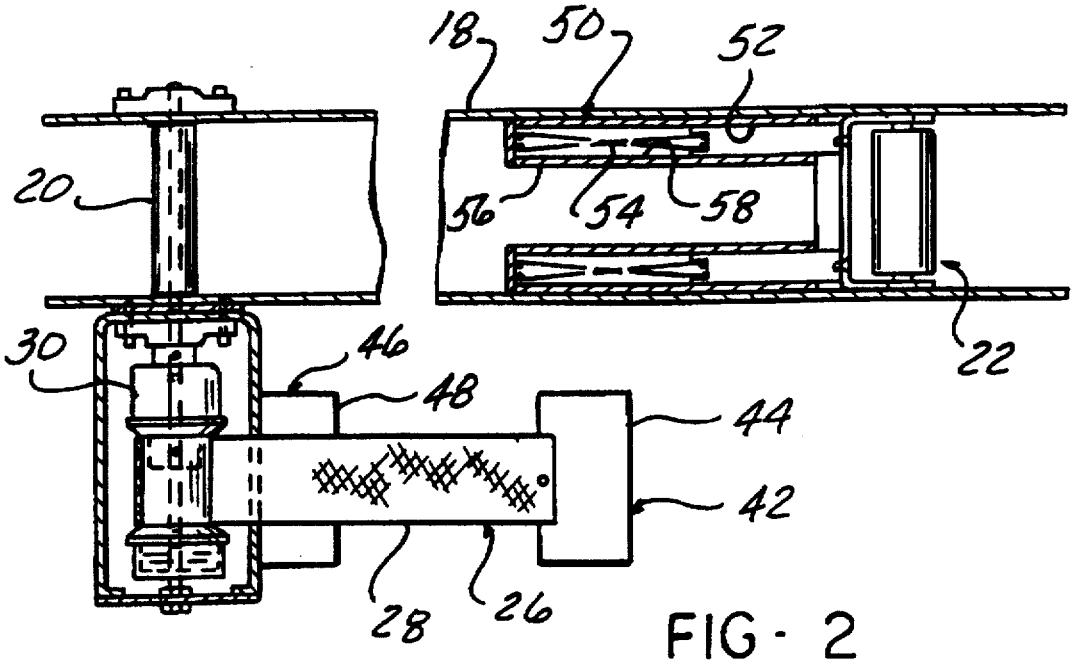
FIG. 2 is a partial cross-sectional, plan view of the indexing conveyor.
Figure 3:
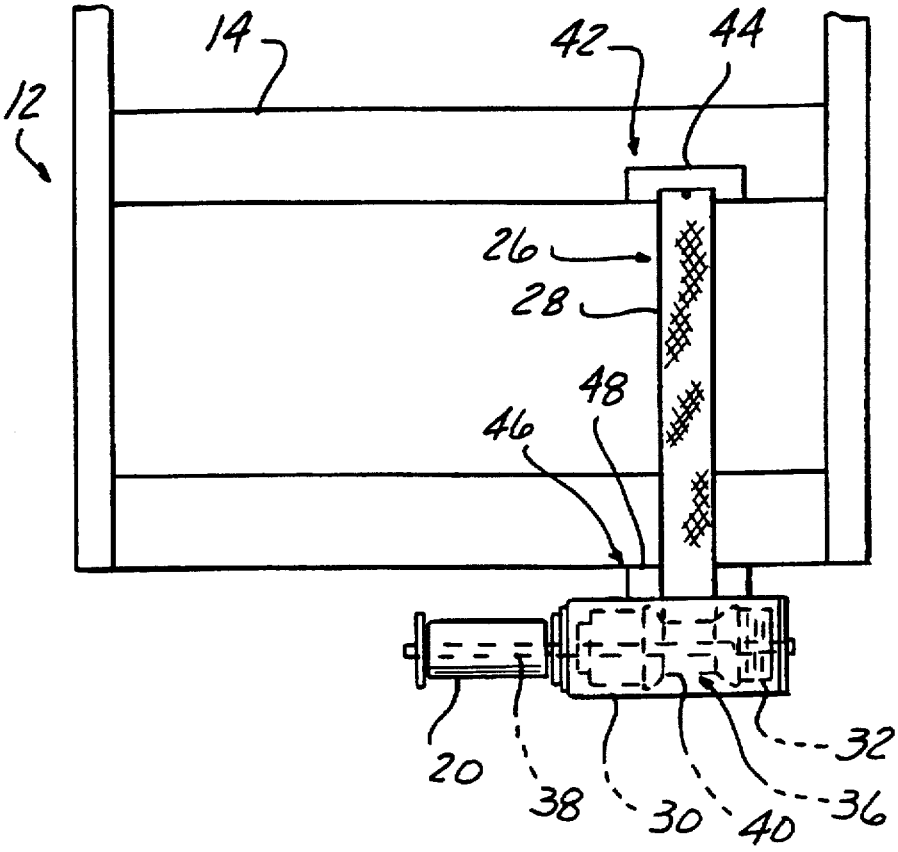
FIG. 3 is a schematic side elevational view of the indexing conveyor connected to a bolster plate and a reciprocal ram of a press according to the present invention.

An apparatus 10 according to the present invention is connectible with respect to a press 12 having a ram 14 reciprocating with respect to a bolster plate 16 as can be seen in FIG. 3. As best seen in FIGS. 1 and 2, the apparatus 10 includes a frame 18 having a first end with a drive roller 20 and a second end with a nose piece or idler roller 22. An endless belt 24 extends around the drive roller 20 and idler roller 22. The elongated conveyor means or apparatus 10 is connectible to the press 12 for moving material with respect to the press. The conveyor means 10 includes endless conveyor belt 24 disposed about a drive pulley or roller 20 at one end and an idler roller 22 at an opposite end. Flexible means 26 is connectible between the conveyor means 10 and the reciprocal ram 14 for converting reciprocating movement of the ram 14 into indexing movement of the endless conveyor belt 24 through the drive pulley 20.

The flexible converting means 26 can include an elongated webbing means 28 for connecting the drive roller 20 to the reciprocal ram 14 and for converting reciprocating movement of the ram 14 into indexing rotary movement of the drive pulley. Clutch means 30 connects between the flexible converting means 26 and the drive pulley 20 for transmitting rotary motion in one direction while allowing free wheeling rotary motion in an opposite direction. By way of example and not limitation, a suitable clutch mechanism can be obtained commercially from Warner Electric of South Beloit, Ill., Formspraig Facility identified as a HPI indexing clutch used to convert reciprocating linear motion to incremental rotary motion for conveyor or material feed applications. In this type of application, reciprocating motion applied to the driving race is transformed into intermittent motion in only one direction at the driven race of the indexing clutch. For example, if a pinion is connected to the driving race, a rack meshing with the pinion can give reciprocating motion to the driving race. The clutch will then advance or index work (driven race) on each forward stroke of the rack, but will not return or back-up on the return stroke of the rack. In the present application, biasing means 32 is connected to the clutch means 30 for urging the flexible converting means in a rotational direction opposite from the indexing movement. The biasing means 32 may include a spring 34, such as a spirally wound torsion spring or any other suitable biasing member. Spool means 36 is provided for storing and for dispensing the flexible converting means 26. In the illustrated embodiment as seen in FIG. 1, the spool means 36 and the drive pulley 20 have a common rotational axis. The flexible converting means 26 can include an elongated drive shaft 38 for transmitting rotary motion in one direction and for free wheeling rotary motion in an opposite direction. A spool 40 can be connected to the clutch means 30 opposite from the drive shaft 38 for imparting driving movement to the clutch means 30 in the desired rotary direction. Biasing means 32 urges the spool 40 in an opposite rotational direction for free wheeling rotary motion of the clutch means 30. Elongated flexible webbing means 28 is connected to the spool 40 at one end and normally disposed wound around the spool 40 with an opposite end extending external of the spool 40. The opposite end is connectible with the reciprocal ram 14 of the press 12. The webbing means 28 converts reciprocal motion of the ram 12 into rotary motion of the spool 40 in the desired rotational direction as the ram 14 moves away from the spool 40, such that the webbing means 28 is rewound around the spool 40 as the ram 14 moves toward the spool 40 in response to the biasing means 32 urging free wheeling rotary movement of the spool 40 in the opposite rotational direction.

Means 42 can be provided for operably connecting the opposite end of the elongated webbing means 28 to the reciprocal ram 14. The connecting means 42 can include at least one magnet 44 connected to the opposite end of the elongated webbing means 28 and engageable with the reciprocal ram 14. Means 46 is also provided for attaching the conveyor means 10 to the press 12. The attaching means 46 can include at least one magnet 48 connected to the conveyor means 10 adjacent the drive pulley 20 and engageable with the press 12 to hold the conveyor means 10 in a desired position with respect to the press 12 while indexing the endless belt 24 in response to reciprocal movement of the ram 14 with respect to the bolster plate 16.

Means 50 can be provided for biasing the idler roller or nose piece 22 to maintain the endless conveyor belt 24 in tension between the idler roller 22 and the drive pulley 20. The biasing means 50 can include a member 52 for supporting the idler roller 22 for movement with respect to the frame 18. The member 52 can be biased in a longitudinal direction with respect to the elongated frame 18 opposite from the drive roller 20. The biasing force can be provided by at least one compression spring engageable between the frame 18 and the member 52 supporting the idler roller 22. As illustrated in FIG. 1, the member 52 may include at least one longitudinally extending guide 56 engageable within a corresponding aperture 58 form connected to the frame 18, such that the compression spring is disposed within the aperture and compressed by longitudinally reciprocal movement of the guide 56 within the aperture 58 in order to maintain a desired tension on the endless belt 24 during indexing movement.

The present invention disclosed an elongated conveyor means 10 that can be easily attached to any press 12 with just two magnets. The first magnets holds the indexing conveyor means 10 in place on the bolster plate 16. The second magnet attaches the webbing means 28 to the ram 14 of the press. In operation, as the ram 14 retracts from the bolster plate 16 of the press, the conveyor is indexed forward a predetermined linear distance. When the ram 14 is driving toward the bolster plate 16, the biasing means 32 causes the webbing means 28 to be retracted and wound around the spool means 36. Therefore, on every stroke of the ram, the webbing is rewound on the spool while the ram 14 moves toward the bolster plate 16, and the spool through the clutch means 30 drives the endless belt 24 as the ram 14 moves away from the bolster plate 16 of the press. The use of magnets to mount the conveyor means 10 allows the conveyor to be easily and quickly installed without any tools to any press currently in operation. This particular design is adapted for use with small parts conveyors, and eliminates the need for a separate electric motor and control circuitry to drive the indexing conveyor. Preferably, the conveyor frame can be built out of 401 stainless steel. The nose piece 22 of the present invention also automatically provides the appropriate belt tension on the endless belt 24 allowing the belt to track evenly as it indexes about the drive roller 20 and idler roller. Preferably, the nose piece 22 is urged outwardly by biasing means 50 to keep the proper tension on the belt 24. The biasing means 50 preferably includes dual compression springs built into the conveyor means 10 disposed between the frame 18 and the nose piece 22. This construction eliminates the bolts and adjustment screws which can easily be misaligned when manually tightening the belt causing the belt to track improperly and resulting in premature belt failure.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for driving material with respect to a press having a reciprocal ram and bolster plate, said apparatus comprising:

elongated conveyor means connectible to said press for moving material with respect from said press, said conveyor means including an endless conveyor belt disposed about a drive pulley at one end and an idler roller at an opposite end;

flexible means, connectible between said conveyor means and said reciprocal ram, for converting reciprocating movement of said ram into indexing movement of said endless conveyor belt through said drive pulley; and magnetic means for operably connecting said flexible means to said reciprocable ram and for connecting said conveyor means to said press.

2. The apparatus of claim 1 wherein said flexible converting means further comprises:

elongated webbing means for connecting said drive pulley to said reciprocal ram and for converting reciprocal movement of said ram into indexing rotary movement of said drive pulley.

3. The apparatus of claim 1 further comprising:

clutch means connected between said flexible converting means and said drive pulley for transmitting rotary motion in one direction, while allowing free wheeling rotary motion in an opposite direction.

4. The apparatus of claim 1 further comprising:

means for biasing said flexible converting means in a rotational direction opposite from said indexing movement.

5. The apparatus of claim 1 further comprising:

spool means for storing and for dispensing said flexible converting means.

6. The apparatus of claim 5 further comprising:

said spool means and said drive pulley having a common rotational axis.

7. The apparatus of claim 1 wherein said flexible converting means further comprises:

an elongated drive shaft connected to said drive pulley;

clutch means connected to said drive shaft for transmitting rotary motion in one direction and for free wheeling rotary motion in an opposite direction;

a spool connected to said clutch means opposite from said drive shaft for imparting driving movement to said clutch means in said one direction;

means for biasing said spool in said opposite direction for free wheeling rotary motion of said clutch means; and elongated flexible webbing means, connected to said spool at one end and normally disposed wound around said spool with an opposite end extending external of said spool, said opposite end connectible with said reciprocal ram of said press, said webbing means for converting reciprocal motion of said ram into rotary motion of said spool in said one direction as said ram moves away from said spool, such that said webbing means is rewound around said spool as said ram moves toward said spool in response to said biasing means urging free wheeling rotary movement of said spool in said opposite direction.

8. The apparatus of claim 7 further comprising:

said magnetic means for operably connecting said opposite end of said elongated webbing means to said reciprocable ram.

9. The apparatus of claim 8 wherein said magnetic connecting means further comprises:

at least one magnet connected to said opposite end of said elongated webbing means and engageable with said reciprocable ram.

10. The apparatus of claim 1 wherein said magnetic means further comprises:

at least one magnet connected to said conveyor means adjacent said drive pulley and engageable with said press to hold said conveyor means in a desired position with respect to said press while indexing.

11. The apparatus of claim 1 further comprising:

means for biasing said idler roller to maintain said endless conveyor belt in tension between said idler roller and said drive pulley.

12. The apparatus of claim 11 further comprising:

said conveyor means having an elongated frame extending along a fixed path between said drive pulley and said idler roller, said elongated frame having at least one aperture formed therein adjacent said idler roller;

a support frame connected said idler roller and having at least one elongated member connected thereto extending along said fixed path, said support frame engageable within said aperture of said elongated frame; and means for biasing said support frame in a direction away from said drive pulley.

13. The apparatus of claim 12 further comprising:

said biasing means including at least one compression spring disposed within said aperture in said elongated frame for biasing said support frame outwardly along said fixed path.

14. An apparatus for driving material with respect to a press having a reciprocal ram and bolster plate, said apparatus comprising:

an elongated conveyor frame connectible to said press for moving material with respect from said press;

a drive pulley connected to one end of said elongated conveyor frame;

an idler roller connected to an opposite end of said elongated conveyor frame;

an endless elongated conveyor belt disposed about said drive pulley at said one end and said idler roller at said opposite end;

a drive shaft connected to said drive pulley and extending outwardly therefrom;

a clutch connected to said drive shaft for allowing free wheeling rotational movement in a first rotational direction of said drive pulley and for providing positive driving rotation in a second rotational direction;

a spool connected to an opposite end of said clutch from said drive pulley for free wheeling rotation in said first rotational direction and for driving rotation in said second rotational direction to rotate said drive pulley;

an elongated flexible web connected to said spool at first end and having a longitudinal length wound around said spool with a second end extending free outwardly from said spool, said second end connectible to said ram of said press;

a torsion spring connected to said spool for biasing said spool in said first rotational direction, such that movement of said ram toward said bolster plate of said press allows said web to be rewound about said spool in response to urging of said torsion spring and movement of said ram away from said bolster plate provides rotational driving movement of said spool through said clutch to said drive pulley for indexing said conveyor belt;

at least one magnet connected to said opposite end of said elongated flexible web and engageable with said reciprocable ram; and at least one magnet connected to said conveyor frame adjacent said drive pulley and engageable with said press to hold said conveyor frame in a desired position with respect to said press while indexing.

15. In an apparatus for removing material from a press having a reciprocal ram, the improvement comprising:

elongated conveyor means connectible to said press for removing material from said press, said conveyor means including an endless conveyor belt disposed about a drive pulley at one end and an idler roller at an opposite end;

flexible means, connectible between said conveyor means and said reciprocal ram, for converting reciprocating movement of said ram into indexing movement of said endless conveyor belt through said drive pulley; and magnetic means for operably connecting said flexible means to said reciprocable ram and for connecting said conveyor means to said press.

* * * * *